US005445765A

United States Patent [19]

Elfers et al.

[11] Patent Number: 5,445,765

[45] Date of Patent: Aug. 29, 1995

[54] PETROLEUM EMULSION BREAKERS

[75] Inventors: Guenther Elfers, Birkenau; Wilfried Sager, Mutterstadt; Hans-Henning Vogel, Frankenthal; Knut Oppenlaender, Ludwigshafen, all of Germany

[73] Assignee: BASF Aktiengesellschaft, Ludwigshafen, Germany

[21] Appl. No.: 971,201

[22] Filed: Nov. 4, 1992

[30] Foreign Application Priority Data

Nov. 7, 1991 [DE] Germany ..... 41 36 661.1

[51] Int. Cl.[6] ..... B01D 17/04

[52] U.S. Cl. ..... 252/344; 252/358; 210/708

[58] Field of Search ..... 252/344, 358; 210/708

[56] References Cited

U.S. PATENT DOCUMENTS

| | | | |
|---|---|---|---|
| 3,454,380 | 7/1969 | Dickson et al. | 44/63 |
| 3,684,735 | 8/1972 | Oppenlaender et al. | 252/342 |
| 3,893,615 | 7/1975 | Johnson | 232/43.2 |
| 3,907,701 | 9/1975 | Liebold et al. | 252/344 |
| 3,997,479 | 12/1976 | Shimojo et al. | 252/520 |
| 4,333,947 | 6/1982 | Karjalainen et al. | 424/273 |
| 4,537,701 | 8/1985 | Oppenlaender et al. | 252/344 |

OTHER PUBLICATIONS

Derwent Abstract AN 73-79941U/52 (corresponding to DE 2 227 546).

Derwent Abstract AN 85-203991/34 (corresponding to DE 3 404 538).

*Primary Examiner*—Gary L. Geist
*Assistant Examiner*—Daniel S. Metzmaier
*Attorney, Agent, or Firm*—Keil & Weinkauf

[57] ABSTRACT

Petroleum emulsion breakers based on alkoxylated polyethyleneimines are obtained by reacting polyethyleneimine with a molecular weight of 2,500–35,000 with 5–40 moles each of propylene oxide and ethylene oxide per ethyleneimine unit in the polyethyleneimine and are used for the demulsification of petroleum emulsions at from 10° C. to 130° C.

6 Claims, No Drawings

PETROLEUM EMULSION BREAKERS

The invention relates to petroleum emulsion breakers based on alkoxylated polyethyleneimines and to a method for the demulsification of petroleum emulsions in which the petroleum emulsion breakers according to the invention are employed.

During the production and processing of crude oil large amounts of oil/water emulsions are produced, and the continuous external phase depends on the ratio of the amounts of water and oil, on the natural emulsifier system contained in the oil and on the history of the production of the emulsions. During production most of the crude oil is in the form of a water-in-oil emulsion which must be broken by addition of chemical demulsifiers.

It is known to employ block copolymers of ethylene oxide and propylene oxide to break water-in-oil emulsions. DE-A 15 45 250 discloses, for example, a dewatering method in which various alkylene oxide polymers and compounds derived therefrom with hydrophilic end groups are added to the water-in-oil emulsions, but these display their complete activity insufficiently quickly and often only at elevated temperatures. Moreover, the residual amounts of water, salt or emulsion after they have been used are still too high and, in particular, they have sufficient activity only for a few specific types of oil.

The water-in-oil emulsions are frequently heated, with great energy expenditure, in order to achieve by chemical or electrical/chemical means the low contents of water, salt and possibly emulsion which are required for further processing.

However, it is desirable to be able to break water-in-oil emulsions at the temperatures at which they are produced, ie. from 10° C. to 40° C., with the addition of suitable agents and without heating.

Experience to date has shown that it is impossible to find an emulsion breaker which can be used for all types of crude oil, owing to the differing characteristics of crude oils.

However, it is still desirable to develop emulsion breakers which can be used for larger amounts of related types of oil, since otherwise an excessive number of products would be necessary in this area.

DE-A 22 27 546 discloses that rapid dewatering of crude oil is possible by addition of demulsifying substances based on derivatives of polyalkylene oxides. The method comprises adding to the crude oils at least one polyalkylene-polyamine which is completely alkoxylated, in each case 10–300 times, on the nitrogen atoms and which has at least two repeating alkyleneimine units in the molecule.

The brine separated off in this way still contains a certain amount of oil, there being preferential formation of oil-in-water emulsions. The amount of emulsified crude oil in the oil-in-water emulsions can be up to 5%. Specific demulsifiers, called deoilers, are used to remove this remaining oil and are usually cationic polymers, as described, for example, in DE 34 04 538. Typical products are likewise described in U.S. Pat. Nos. 4,333,947 and 3,893,615.

The removal of remaining oil is necessary for clarification and treatment of the water in the oil field for ecological and technical reasons, since, for example when the water is used for secondary recovery by flooding, oil remaining in the water would increase the injection pressure.

It is desirable for the emulsion breakers used for water-in-oil emulsions also to have a pronounced deoiler effect, ie. to result in one step in removal of the remaining water substantially oil-free.

For this purpose, DE 24 35 714 A1 describes the complete quaternization of the polyalkylene-polyamines disclosed in DE-A 22 27 546. However, this additional step is costly and is therefore to be avoided.

It is an object of the present invention to provide petroleum emulsion breakers which not only efficiently break water-in-oil emulsions but also result in the separated water having a minimum remaining oil content, and which are simple to prepare.

We have found that this object is achieved by petroleum emulsion breakers based on alkoxylated polyethyleneimines, which are obtained by alkoxylation of polyethyleneimines with a molecular weight $M_w$ of 2,500–35,000 with 5–40 moles of propylene oxide and 5–40 moles of ethylene oxide per ethyleneimine unit in the polyethyleneimine.

Although DE-A 22 27 546 discloses crude oil emulsion breakers prepared by alkoxylation, especially with ethylene oxide and propylene oxide, of polyalkylene-polyamines, the ratios of the amounts of alkylene oxide and polyalkylene-polyamines stated therein cover a very wide range (each nitrogen atom alkoxylated 10 to 300 times) and, according to the examples, polyethyleneimines with a $M_w$ of 2,100–86,000, reacted with 70–95 moles of propylene oxide and 20–28 moles of ethylene oxide, are employed.

It was therefore surprising that polyethyleneimines with a particular molecular weight and a low degree of alkoxylation, in particular propoxylation, not only act as efficient water-in-oil demulsifiers but, in addition, also have an excellent deoiler effect, without quaternization being necessary.

Preferred emulsion breakers are obtained by alkoxylation of polyethyleneimines with a molecular weight $M_w$ of 5,000–25,000 with 5–30 moles of propylene oxide and 5–20 moles of ethylene oxide, in each case based on one ethyleneimine unit in the polyethyleneimine.

The emulsion breakers according to the invention have the advantage that they contain no metal salts, especially corrosion-promoting chlorides.

The present invention also relates to a method for the demulsification of petroleum emulsions in which the emulsion is treated at from 10° C. to 130° C., preferably from 50° C. to 80° C., with the petroleum emulsion breaker according to the invention or with solutions which contain the petroleum emulsion breaker.

The emulsion breakers are prepared in a conventional manner in one or more stages, preferably two stages.

The two-stage preparation comprises, for example, in the first stage exposing the polyethyleneimine in the presence of 1–50% by weight of water in a stirred pressure vessel at about 80°–100° C. to sufficient alkylene oxide for the corresponding aminoalkanol to be produced with replacement of all the hydrogen atoms on the nitrogens.

In the second stage, after removal of the water, where appropriate under reduced pressure, about 0.5–2% by weight, based on anhydrous amino alcohol from the first stage, of an alkaline catalyst such as sodium methylate, potassium tert-butylate, potassium or sodium hydroxide, basic ion exchangers etc. are added, which is followed by further alkoxylation with the required amounts of alkylene oxide at about 125°–135° C.

In the one-stage preparation, the reaction can be carried out, for example, by injecting the total amount of the alkylene oxide in the presence of water-containing or anhydrous alkaline catalyst as defined above, and allowing reaction to go to completion at 125°–135° C. In this case there may be a larger proportion of by-products such as pure polyalkylene glycol ethers, but this has no substantial effect on the required properties of the products.

In the preparation of the emulsion breakers according to the invention, for example in the first stage 1,2-propylene oxide is injected to produce the corresponding propanolamine, and then further propylene oxide and finally ethylene oxide are injected. However, the reverse procedure is also possible, ie. injection first of ethylene oxide and then of propylene oxide. Both variants can be carried out in one or two stages.

It is possible to use mixtures of propylene oxide and ethylene oxide according to a scheme of copolymerization.

The ratio of propylene oxide to ethylene oxide in this case can vary within the limits indicated above.

Concerning the alkoxylation step described above, express reference is made to DE-A 22 27 546 and the disclosures therein.

The starting materials for preparing the compounds added according to the invention are generally known polyethyleneimines prepared in a conventional manner from ethyleneimine. The stated molecular weights were determined by light scattering.

The emulsion breakers according to the invention can also be used together with other emulsion breakers, eg. with the alkoxylated alkylphenol/formaldehyde resins disclosed in DE-A 27 19 978.

The emulsion breakers are preferably employed as 20–90% by weight solutions because this makes metering easier. Solvents which can be used are mixtures of organic solvents (eg. methanol) with water or organic solvents alone with boiling points from 50° C. to 200° C., eg. toluene, xylenes, tetrahydrofuran, dioxane, $C_1$–$C_{13}$-alcohols, glycols and light petroleum fractions boiling within the said limits.

In the case of the preferred use of solutions, these are expediently adjusted to a content of agent (emulsion breaker) of 40–60% by weight or 70–90% by weight. To break emulsions, the solutions are preferably added to the wells (in the field). The water-in-oil emulsion is then broken at the temperature at which it is produced, at a rate such that it can be broken even while traveling to the processing plant. There it is separated into pure oil and brine without difficulty in a separator, which may be heated if necessary, and possibly with the aid of an electric field.

The emulsion breakers are expediently added to the crude oil emulsion in amounts (agent) of 0.1–200 ppm, preferably 5–50 ppm, based on the weight of the emulsion to be broken, at from 10° C. to 130° C., preferably from 50° C. to 80° C.

The rapid emulsion breakers to be used according to the invention can be used for water-in-oil emulsions with a brine content of about 0.1–99% by weight. Oils which can be rapidly dewatered in this way are crude oil emulsions with a wide variety of origins.

EXAMPLES

1. Preparation of the emulsion breaker A (synthesis example)

1st stage: The following were placed in a stirred autoclave 0.63 kg of polyethyleneimine (corresponds to 6.0 mole based on monomeric ethyleneimine) (Polymin G 500, agent content: 41% in water, molecular weight 16,000–19,000 by light scattering) under nitrogen.

0.35 kg of propylene oxide (6.0 mole based on monomeric ethyleneimine) was injected at 90°–95° C. The mixture was stirred until the pressure was constant and was cooled to 80° C., and the water was removed under reduced pressure. 608 g (quantitative) of a highly viscous brownish oil were obtained.

2nd stage: The product from stage 1 (608 g) was introduced into a stirred autoclave with 10.0 g of potassium tert-butylate (1% of the weight of the starting materials in stage 1). The reactor was flushed several times with nitrogen and then heated to 125° C., and the following were injected:

8.37 kg (190 mole) of ethylene oxide and 8.70 kg (150 mole) of propylene oxide at 130° C. After cooling to 80° C., 17.7 kg of product were obtained.

2. Examples of use 2.1 Activity as water-in-oil emulsion breakers

The emulsion breaker A prepared in the synthesis example is added in an amount of 25 ppm with stirring to three different crude oil emulsions from West Africa at 40° C., and then the samples are left to stand. The amounts of water separated out were measured after defined time intervals.

For comparison, the petroleum emulsions were mixed with an emulsion breaker B which had been prepared by alkoxylation of a polyethyleneimine with a molecular weight of about 21,000 ($M_w$) with 36 moles of ethylene oxide and 86 moles of propylene oxide per ethyleneimine unit, in the way indicated above.

TABLE I

| | | ml of $H_2O$ separated out after | | | | | | |
|---|---|---|---|---|---|---|---|---|
| | Emulsion breaker | 10 min | 20 min | 30 min | 45 min | 1 h | 2 h | 3 h |
| Crude oil | A | 4 | 15 | 40 | 43 | 45 | 45 | 47 |
| emulsion I | B | 8 | 15 | 25 | 40 | 43 | 47 | 47 |
| Crude oil | A | 2 | 5 | 25 | 35 | 38 | 38 | 39 |
| emulsion II | B | 1 | 3 | 5 | 10 | 15 | 20 | 22 |
| Crude oil | A | 40 | 40 | 40 | 40 | 40 | 40 | 40 |
| emulsion III | B | 0 | 2 | 2 | 2 | 2 | 2 | 2 |

2.2 Activity as deoiler in oil-in-water emulsions 100 ml of the petroleum emulsion to be tested were placed in graduated transparent bottles with a rectangular cross-section and a capacity of 177.44 ml. 25 ppm of the demulsifier were added to the emulsions in the bottles which were then shaken 100 times and assessed for clarity of the water using the scoring scheme below.

Scoring scheme

10 Untreated: no change in the appearance of the emulsion

9 Slight change in color of the emulsion

8 Emulsion shows distinct color change

7 Water pale yellow

6 Water white—numbers or letters on the base of the bottle can be seen

5 Water white—numbers or letters on the long side of the bottle can be seen when viewed through the bottle parallel to the narrow side 4 Water white—numbers on the long side of the bottle can be read when viewed through the bottle parallel to the narrow side 3 Water white—numbers on the narrow side of the bottle can be seen when viewed through the bottle parallel to the long side 2 Water white—numbers on the narrow side of the bottle can be read when viewed through the bottle parallel to the long side 1 Very clean water—numbers on the narrow side of the bottle can be read very easily when viewed through the bottle parallel to the long side.

The test emulsions were the crude oil emulsions indicated in Example 2.1, which were treated with the demulsifier at ambient temperature. The results are shown in Table II.

TABLE II

| Emulsion breaker | Crude oil emulsion | Score |
|---|---|---|
| A | I | 2 |
| B | I | 8 |
| A | II | 3 |
| B | II | 6 |
| A | III | 1 |
| B | III | 9 |

It is evident from the results that the petroleum emulsion breaker according to the invention has advantageous properties (Table I) compared with a comparative substance which differs from the emulsion breaker according to the invention essentially by a distinctly higher degree of propoxylation. In addition, with the emulsion breaker according to the invention there is, in particular, very good separation of the remaining oil from the water which has separated out (Table II).

This makes it clear that the interaction between the specific parameters characterizing the petroleum emulsion breakers according to the invention (ie. molecular weight of the polyethyleneimine employed, degrees of propylation and ethoxylation) results in an emulsion breaker which has considerable advantages over those previously disclosed.

We claim:

1. A petroleum emulsion breaker based on alkoxylated polyethyleneimines, which is obtained by alkoxylation of polyethyleneimines with a molecular weight $M_w$ of 16,000–19,000 with about 26 moles of propylene oxide and about 31.7 moles of ethylene oxide per ethyleneimine unit in the polyethyleneimine.

2. A petroleum emulsion breaker as defined in claim 1, which contains as second active component an alkoxylated alkylphenol/formaldehyde resin.

3. A concentrated solution of a petroleum emulsion breaker, which is composed of 20–90% by weight of petroleum emulsion breaker as defined in claim 1 and 10–80% by weight of an organic solvent.

4. A concentrated solution as defined in claim 3 wherein the organic solvent contains $H_2O$.

5. A method for the demulsification of petroleum emulsions, which comprises treating the emulsion at from 10° C. to 130° C. with a solution of the emulsion breaker as defined in claim 1.

6. A method as defined in claim 5 wherein the emulsion is treated at from 50° C. to 80° C.

* * * * *